US009884354B2

(12) United States Patent
Forte et al.

(10) Patent No.: US 9,884,354 B2
(45) Date of Patent: Feb. 6, 2018

(54) WATER DISPENSER WITH A CLEANING MECHANISM

(71) Applicant: NEVIOT-NATURE OF GALILEE LTD., Lod (IL)

(72) Inventors: Yehuda Forte, Yavne (IL); Maayan Bronstein, Hadera (IL)

(73) Assignee: NEVIOT-NATURE OF GALILEE LTD., Lod (IL)

( * ) Notice: Subject to any disclaimer, the term of this patent is extended or adjusted under 35 U.S.C. 154(b) by 0 days.

(21) Appl. No.: 14/972,140

(22) Filed: Dec. 17, 2015

(65) Prior Publication Data

US 2016/0101447 A1 Apr. 14, 2016

Related U.S. Application Data

(62) Division of application No. 14/368,303, filed as application No. PCT/IL2012/050551 on Dec. 25, 2012, now Pat. No. 9,243,387.

(30) Foreign Application Priority Data

Dec. 26, 2011 (IL) ..... 217213

(51) Int. Cl.

| | |
|---|---|
| ***B67D 1/07*** | (2006.01) |
| ***B08B 9/08*** | (2006.01) |
| ***B67D 3/00*** | (2006.01) |
| ***B67D 1/00*** | (2006.01) |
| ***E03B 7/07*** | (2006.01) |
| ***E03B 11/02*** | (2006.01) |
| ***B67D 1/08*** | (2006.01) |
| ***B67D 1/10*** | (2006.01) |

(52) U.S. Cl.

CPC ..... *B08B 9/08* (2013.01); *B67D 1/0004* (2013.01); *B67D 1/07* (2013.01); *B67D 1/0857* (2013.01);

(Continued)

(58) Field of Classification Search

CPC ..... B67D 1/0004; B67D 1/07; B67D 1/0857; B67D 1/0888; B67D 1/0895; B67D 1/10;

(Continued)

(56) References Cited

U.S. PATENT DOCUMENTS 5,042,689 A * 8/1991 Mrugala ..... B67D 1/0858 222/146.1
5,573,142 A * 11/1996 Morellato ..... B01D 61/08 222/129.1

(Continued)

FOREIGN PATENT DOCUMENTS

JP S60-29027 A 9/1985
JP H11-190577 A 12/1997

(Continued)

*Primary Examiner* — Charles P Cheyney
(74) *Attorney, Agent, or Firm* — Soroker Agmon Nordman

(57) ABSTRACT

The subject matter discloses a water dispenser, comprising a water container, a water supply system, a fluid pump and a control unit. The water supply system is configured to supply water from the water container to a hot water reservoir and to a cold water reservoir and is further configured to provide hot water from said hot water reservoir and cold water from said cold water reservoir to a user of said water dispenser. The fluid pump is fluidly coupled to a fluid flow system and the water supply system and is configured to pump a quantity of hot water from the hot water reservoir to the water container via a fluid flow conduit of the fluid flow system for a cleansing operation of at least the fluid flow system. The control unit is in communication with the fluid pump for controlling the cleansing operation.

20 Claims, 5 Drawing Sheets

(52) U.S. Cl.
CPC ..... *B67D 1/0888* (2013.01); *B67D 1/0895* (2013.01); *B67D 1/10* (2013.01); *B67D 3/0009* (2013.01); *B67D 3/0022* (2013.01); *B67D 3/0032* (2013.01); *E03B 7/078* (2013.01); *E03B 11/02* (2013.01); *B67D 2210/00013* (2013.01); *B67D 2210/00026* (2013.01)

(58) Field of Classification Search
CPC ..... B67D 2210/00013; B67D 3/0009; B08B 9/08
USPC ..... 222/146.1, 67, 129.1, 146.6, 148, 146.2, 222/1
See application file for complete search history.

(56) References Cited

U.S. PATENT DOCUMENTS 6,143,258 A * 11/2000 Tamura ..... A61L 2/24 210/175
6,207,046 B1 * 3/2001 Yamashita ..... B67D 1/07 210/138
7,905,374 B2 * 3/2011 Yui ..... A61L 2/04 222/146.1
9,085,450 B2 * 7/2015 Forte ..... B67D 1/0004
9,480,762 B2 * 11/2016 Wang ..... A61L 2/18
2008/0226521 A1 * 9/2008 Nakano ..... A47J 31/60 422/307
2009/0133430 A1 5/2009 Roetker et el.
2009/0165494 A1 * 7/2009 Muthumani ..... B67D 1/001 62/390
2009/0321335 A1 * 12/2009 Siemer ..... C02F 9/005 210/175

FOREIGN PATENT DOCUMENTS

JP 2006-21793 A 1/2006
JP 2007-91232 A 4/2007
JP 2008-37445 A 2/2008
JP 2009-251772 A 10/2009
JP 3159843 U 6/2010
JP 2011-73736 A 4/2011

* cited by examiner

WATER DISPENSER WITH A CLEANING MECHANISM

FIELD OF THE INVENTION

The subject matter relates generally to water dispensers, and more specifically to mineral water dispensers having a cleaning mechanism.

BACKGROUND OF THE INVENTION

Water dispensers are used in both businesses and for residential use to provide available water to users. The demands to ensure safety of drinking water and to pursue the quality in natural character of drinking water have been increased according to the increase of users' interest with respect to drinking water.

Water dispensers may provide users with filtered water. Such filtered water is received at the water dispenser from a central water system and filtered via a filtering module within the water dispenser. Other water dispensers provide users with mineral water. Such mineral water is packaged in periodically replaced containers. The containers have an outlet connected to a faucet from which the water is dispensed.

Water dispensers having water containers or filtered water suffer from contamination of the tubes in the water dispenser. The tube provides water from the central water system or from the water container to the faucet from which the water is provided to the consumer. Such contamination significantly reduces water quality of the water dispenser. It is desired to provide a system and method for treating such contamination in water dispensers.

SUMMARY

The subject matter discloses a water dispenser apparatus, comprising a cold water tank, a hot water tank and a water outlet for dispensing water from the water dispenser apparatus, said water outlet is connected to the hot water tank and to the cold water tank. The water dispenser apparatus further comprises a suction unit for sucking water from a water tank selected from a group consisting of the cold water tank and the hot water tank, the suction unit is configured to clean tubes and tanks at the water dispenser apparatus and to transfer said water at tubes within the water dispenser apparatus.

In some embodiments, the suction unit comprises a suction tube connected to the cold water rank, a suction unit connected to the suction tube, configured to suck water from the cold water tank via the suction tube and a suction valve allowing water to flow from the suction tube to the hot water tank.

In some embodiments, the apparatus further comprises an outlet valve for controlling water dispensing from the water outlet.

In some embodiments, the apparatus further comprises a hot unit valve for controlling water flow from the suction unit to the hot water tank.

In some embodiments, the hot water is transferred from the hot water tank to tubes within the water dispenser when the hot unit valve allows water to flow from the suction unit to the hot water tank.

In some embodiments, the apparatus further comprises a cold unit valve for controlling water flow to a cold suction tube.

In some embodiments, the cleaning tubes at the water dispensing apparatus comprises cleaning a hot outlet tube and at a cold outlet tube.

In some embodiments, the cleaning the hot outlet tube and the cold outlet tube is performed when the cold unit valve is in a closed state, the hot unit valve is in an open state and the suction valve is in an open state.

In some embodiments, the cleaning the cold suction tube is performed when the cold unit valve is in an open state, the hot unit valve is in a closed state and the suction valve is in an open state.

In some embodiments, a user of the water dispenser activates the suction unit. In some embodiments, a control unit activates the suction unit automatically.

The subject matter discloses a water dispenser apparatus, comprising:

- a water container for containing water to be dispensed to a user of the water dispenser apparatus;
- a cold water tank for receiving water from the water container;
- a hot water tank for receiving water from the water container,
- a suction unit for pumping water from the water container towards the cold water tank and the hot water tank;
- a water outlet for dispensing water from the water dispenser apparatus, said water outlet is connected to the hot water tank and to the cold water tank;
- wherein the suction unit is connected to the outlet of the suction tube for sucking water from the suction tube;
- the suction unit is configured to clean tubes and tanks at the water dispenser apparatus and to transfer said water at tubes within the water dispenser apparatus.

The subject matter discloses a hot/cold water dispenser comprising: a housing enclosing a water container containing water; a water supply system configured to selectively supply water contained in said water container to a hot water reservoir and a cold water reservoir and further configured to selectively provide hot water from said hot water reservoir and cold water from said cold water reservoir to a user of said hot/cold water dispenser, and a fluid pump fluidly coupling a fluid flow system and said water supply system and being operable to pump a quantity of hot water from said hot water reservoir to an empty water container via said fluid flow system, wherein subsequent to emptying a predetermined number of said water containers, said fluid pump is activated for a first predetermined time period to pump said quantity of hot water to said empty water container via said fluid flow system thereby said quantity of hot water cleanses said fluid flow system and said empty water container.

The subject matter also discloses a method for cleansing a hot/cold water dispenser comprising: providing said hot/cold water dispenser, comprising: a housing enclosing a water container, and a water supply system configured to selectively supply water contained in said mineral water container to a hot water reservoir and a cold water reservoir and further configured to selectively provide hot water from said hot water reservoir and cold water from said cold water reservoir to a user of said hot/cold water dispenser, configuring a fluid pump to pump a quantity of hot water for a first predetermined time period from said hot water reservoir to an empty water container via a fluid flow system, and cleansing said mineral water container and said fluid flow system for a second predetermined time period with said quantity of hot water.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

DETAILED DESCRIPTION

The disclosed subject matter provides for a water dispensing apparatus for residential or business use. The subject matter provides a method and system for cleaning the water dispensing apparatus. Such cleaning may be enabled by adding a tube connected to one of the cold water tank or the hot water tank of the water dispensing apparatus and using a suction unit. The suction unit sucks water from one of the water tanks disclosed above and via a plurality of valves. The valves control water flow at tubes within the water dispensing apparatus, such that when cleaning, water flows in a closed system manner at the water tanks and tubes and does not exit the water dispensing apparatus.

Figure 1:
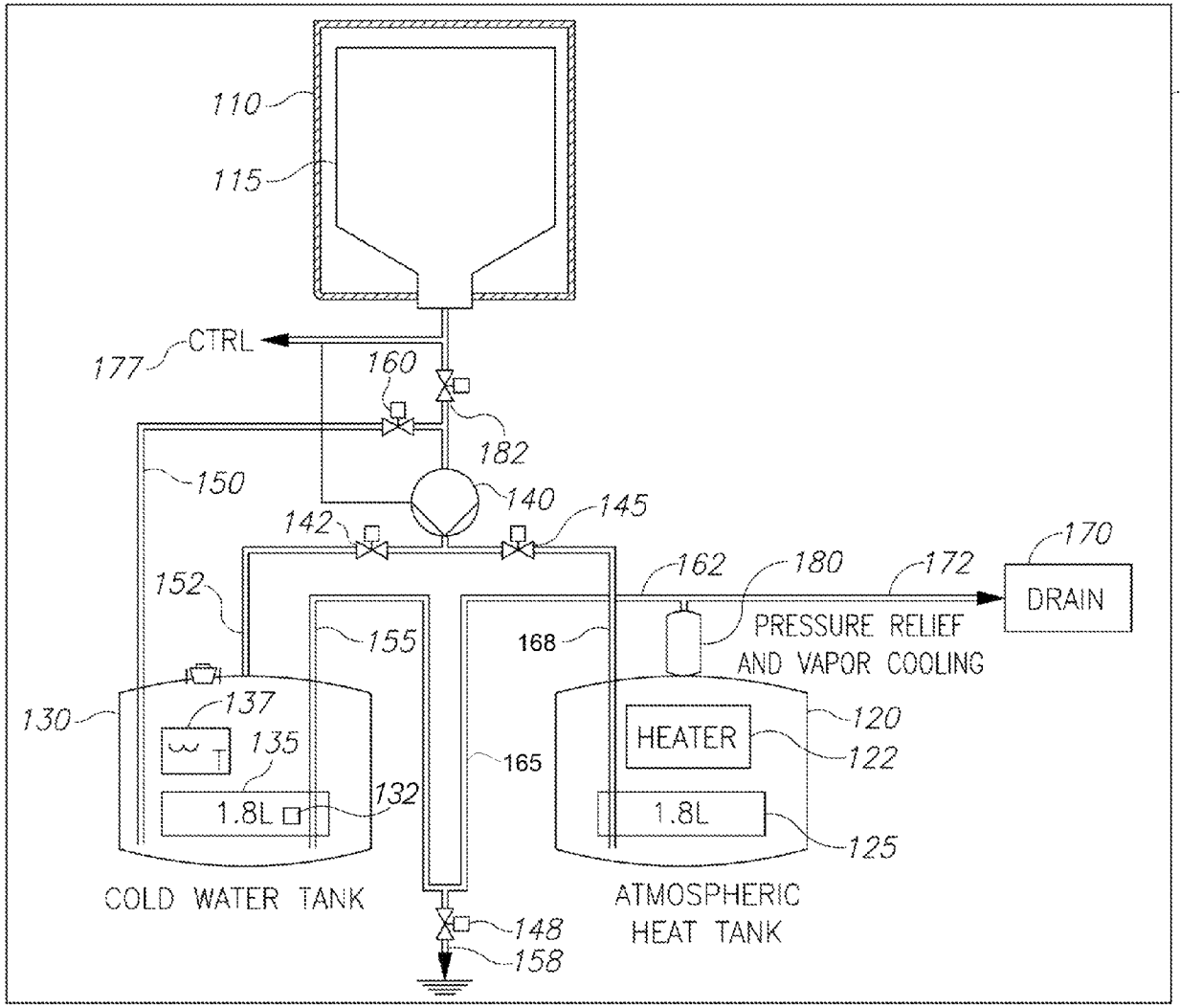
FIG. 1 shows a water dispensing apparatus having a cleaning system, according to some exemplary embodiments of the subject matter.

FIG. 1 shows a water dispensing apparatus having a cleaning system, according to some exemplary embodiments of the subject matter. The water dispensing apparatus 105 is disposed in a housing 110. The housing 110 covers other parts of the water dispensing apparatus, such as tubes, cold water unit, hot water unit and the like. The water dispensing apparatus 105 comprises an outlet 158 from which water are dispensed from the water dispensing apparatus 105.

The water dispensing apparatus 105 comprises a water supplying unit 115. The water supplying unit 115 may be a mineral water container. The water supplying unit 115 may be a bag in a box (BIB) unit, in which the water are contained in a bag, such as a plastic bag, and the bag is disposed in a rigid or semi rigid box, for protection. The water supplying unit 115 may be connected to a central water system from which water is provided to the water dispensing apparatus 105. In such case, water may be filtered or purified at the water dispensing apparatus 105. The water supplying unit 115 is connected to a supply valve 182. The supply valve 182 controls water supply from the water supplying unit 115 to the rest of the water dispensing apparatus 105, towards the outlet 158.

The water dispensing apparatus 105 further comprises a hot water unit 120. The hot water unit 120 comprises a heating unit 122 for heating water contained in a hot water tank 125. The hot water tank 125 is connected to the outlet 158 via a hot outlet tube 165 and an outlet valve 148.

The water dispensing apparatus 105 further comprises a cold water unit 130. The cold water unit 130 comprises a temperature sensor 132 for detecting temperature of water contained in a cold water tank 135. The cold water tank 135 is connected to the outlet 158 via a cold outlet tube 155 and an outlet valve 148. The water dispensing apparatus 105 further comprises a suction unit 140. When cleaning tubes and tanks at the water dispensing apparatus, the suction unit 140 is connected to at least one of the cold water unit 130 or the hot water unit 120 and sucks water from at least one of them.

The suction unit 140 is connected to a power supply (not shown). The suction unit is connected to a control unit 177, from which the suction unit 140 receives a command to perform suction. The control unit 177 may also determine the unit from which the suction unit 140 sucks water, for example the hot water unit or the cold water unit.

In some exemplary cases, the water dispensing apparatus 105 further comprises a cold suction tube 150 connecting the cold water unit 130 to the suction unit 140. When cleaning the tubes of the water dispensing apparatus 105, the suction unit 140 may suck water from the cold water tank 135 via the cold suction tube. The suction unit is located near a cold unit valve 142 and a hot unit valve 145. When sucking water from the cold water tank 135, the amount of water at the cold water tank 135 reduces while water is transferred at the cold suction tube 150. In some exemplary cases, the cold water tank 135 contains water in the range of 1.5-2 liters. A cooling unit 137 regulates the water temperature at the cold water tank 135. When cleaning the tubes and tanks of the water dispensing apparatus, the flow rate of water sucked from the cold water tank 135 by the suction unit 140 may be, for example, in the range of 0.001-3 liters per minute.

In some exemplary cases, the suction unit 140 is configured to pump water from the water supplying unit 115 to the cold water tank 135 and to the hot water tank 125. This way, water from the water supplying unit 115 cannot flow using gravitation. The suction unit 140 may be connected to the outlet of a suction tube, such as the cold suction tube 150. In some exemplary cases, the suction tube may also be connected to the hot water tank 125. The suction tube may be connected on a first end to the suction unit 140 and on a second end to a water tank selected from the cold water tank 135 and the hot water tank 125.

Hence, the suction unit 140 may pump water from the suction tube when performing the cleaning process of the subject matter, it is shown that a single pump, the suction unit 140, both initiates the sanitation process and delivers water from the water supplying unit 115 to the cold water tank 135 and to the hot water tank 125. A single pump embodiment is achieved by positioning the suction tube 150 outlet in the vicinity of the suction unit 140. A single pump that performs both the cleaning process and the water delivery is especially necessary for compact dispensing devices, for residential use. Such compact devices may be of a height of less than 60 centimeters and configured to be located on a kitchen top.

Figure 2:
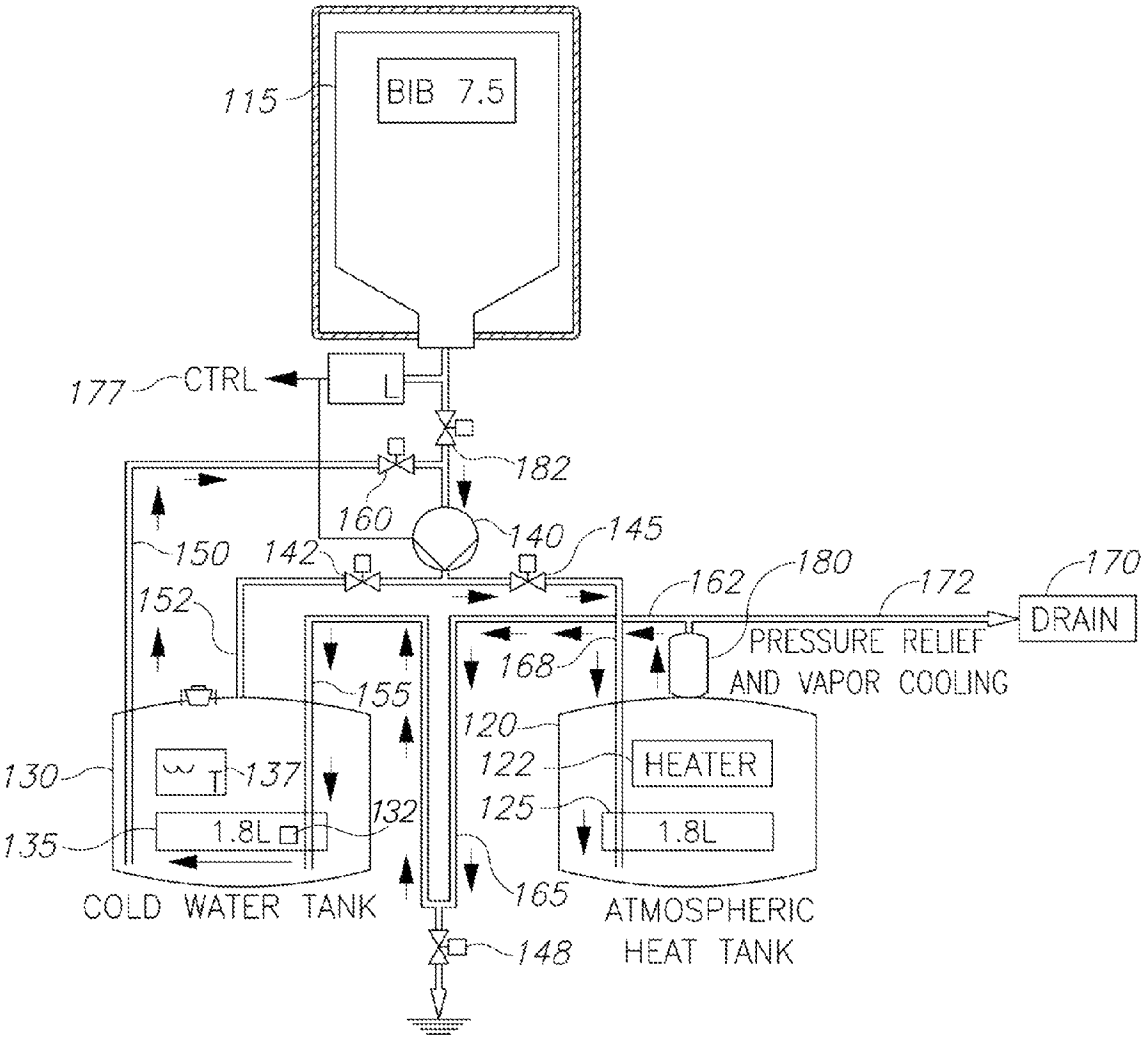
FIG. 2 shows a flow of water at a water dispensing apparatus during a cleaning process, according to exemplary embodiments of the disclose subject matter.
Figure 3:
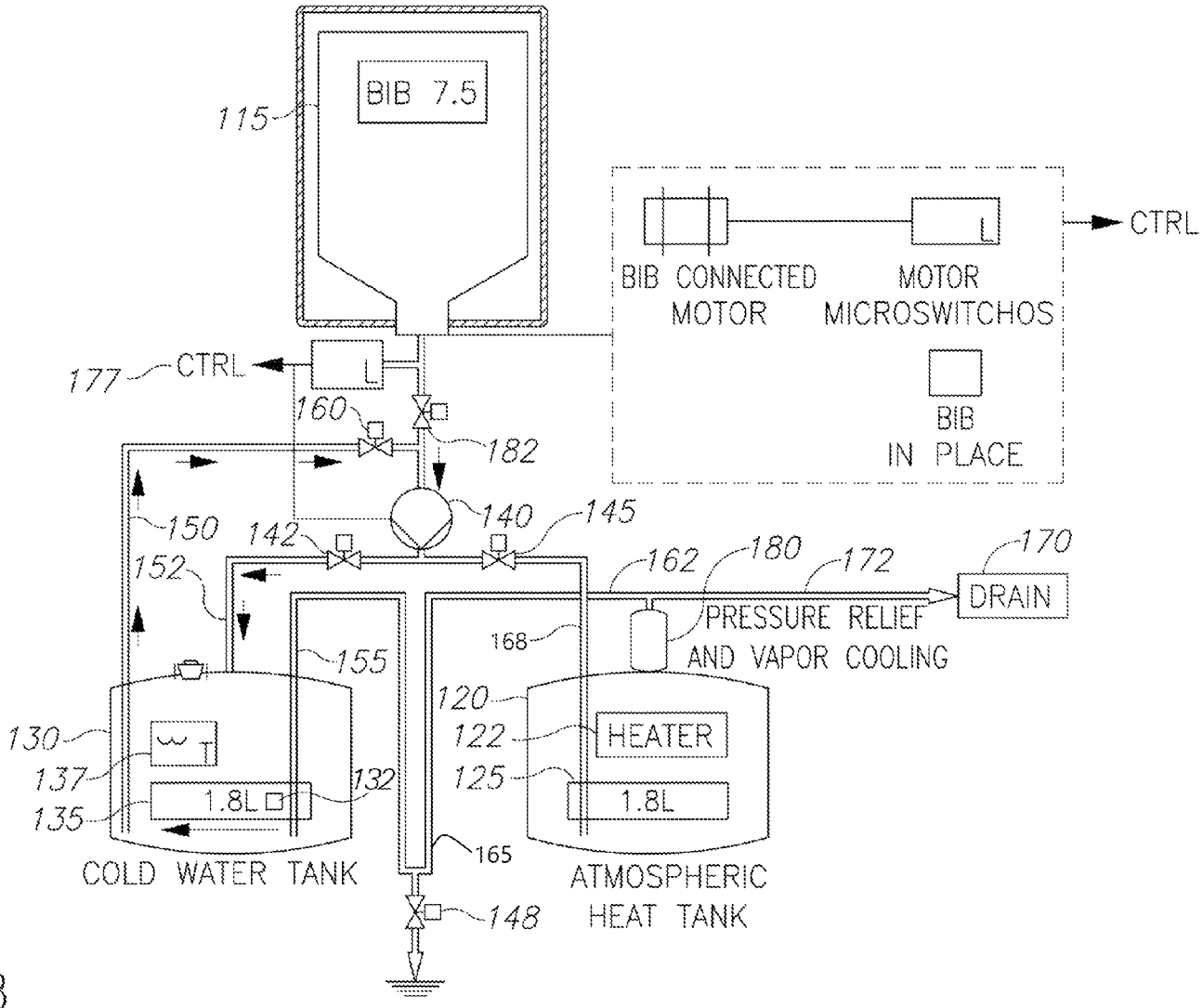
FIG. 3 shows a flow of water at a cold suction tube of a water dispensing apparatus during a cleaning process, according to exemplary embodiments of the disclose subject matter.

FIG. 2 shows a flow of water at a water dispensing apparatus during a cleaning process, according to exemplary embodiments of the disclose subject matter. In the example shown below, water is first sucked from the cold water tank 135. In an alternative embodiment, water can be sucked from the hot water tank 125 by connecting the cold suction tube 150 to the hot water unit 120. In an exemplary embodiment of the disclosed subject matter, cleaning the water dispenser comprises two phases. In the first phase, water flows at the hot outlet tube 165 and at the cold outlet tube 155. In the second phase, water flows at the cold suction tube 152, as shown in FIG. 3.

When cleaning the hot outlet tube 165 and at the cold outlet tube 155 of the water dispensing apparatus 105, the cold unit valve 142 is in a closed state and the hot unit valve 145 is in an open state, the outlet valve 148 is in a closed state and the supply valve 182 is in a closed state. The suction valve 160 is in an open state, allowing water to flow to the suction unit 140. Therefore, water sucked by the suction unit 140 from the cold water tank 135 cannot enter the cold water unit 130 and only flows to the hot water unit 120. The cold unit valve 142 and the hot unit valve 145 are connected to the control unit 177 handling the cleaning process. When cleaning, the control unit 177 transmits commands to the cold unit valve 142 to be in a closed state and to the hot unit valve 145 to be in an open state. In such case, water can flow from the cold water unit 130 to the hot water unit 120 via the suction unit 140. When a command is received from the control unit 177, the cold unit valve 142 is in a closed state and the hot unit valve 145 is in an open state, the suction unit 140 sucks water from the cold water unit 130 and transfers the sucked water to the hot water unit 120.

When water sucked from the cold water unit 130 enters the hot water unit 120, a portion of the water previously contained at the hot water tank 125 may be pushed from the hot water tank 125 via a pressure relief tank 180 to a pressure relief tube 162. The pressure relief tank regulates water flows upwards from the hot water tank 125 to the pressure relief tube 162 for cleaning the tubes at the first cleaning phase. Water then flows from the pressure relief tube 162 to the hot outlet tube 165 flows to the cold outlet tube 155 via the outlet valve 148 and from the cold outlet tube 155 to the cold suction tube 150. From the cold suction tube 150, water flows back to the hot water unit 120 via hot inlet tube 168. Then, water flows from the hot inlet tube 168 via the hot water tank 125 to the pressure relief tube 162. This way, water flow from the hot water tank 125 at the tubes of the cold unit and the hot unit and clean the tubes at the water dispensing apparatus 105.

The pressure relief tube 162 is also connected to a drain tube 172 which leads water to a drain 170. Water pushed from the hot water unit 120 is directed to the pressure relief tube 162 instead of the drain tube 172 by the pressure relief tank 180. When there is excessive water at the pressure relief tank 180, some of the water can flow to the drain 170 via the drain tube where water is gathered and later drained. The drain 170 regulates the atmospheric pressure at the tubes in the water dispensing apparatus 105.

Before circulating water in the water dispensing apparatus, the condenser that cools water at the cold water tank 135 is disabled. Then, the water from the hot water tank circulates in the pumps of the water container apparatus, and water from the cold water tank 135 is circulated into the hot water tank 125. Such circulation takes place for a period of 1-10 minutes, until the water in both the cold water tank 135 and the hot water tank 125 reaches a predefined temperature, for example 87 degrees Celsius. Then, the water is circulated in a higher speed for another period of time, for example 4 minutes. After a circulation period of about 1-10 minutes, hot water flow in the tubes of the water dispensing apparatus, and the cold water unit 130 is cleaned. The cold water tank 135, hot water tank 125 and some of the tubes are cleaned after one circulation period. In some cases, at least a portion of the tubes of the water dispensing apparatus are also cleaned. Such tubes may be the hot inlet tube 168, the cold outlet tube 155, the cold suction tube 150, pressure relief tube 162 and the hot outlet tube 165.

FIG. 3 shows a method and system for cleaning a secondary cycle, according to exemplary embodiments of the disclosed subject matter. In the example disclosed above, a primary cycle is relates to the process of sucking water from one water tank and cleaning the water tank from which water is sucked.

In the example disclosed above, the secondary cycle refers to cleaning the cold suction tube 152. To clean the cold suction tube 152, the cold unit valve 142 is in an open state and the hot unit valve 145 is in a closed state and the supply valve 182 is in closed state.

The suction valve 160 is in an open state, allowing water to flow to the suction unit 140. The outlet valve 148 remains closed when cleaning the cold suction tube 152. When cleaning the cold suction tube 152, water flows from the suction unit 140 via the cold unit valve 142 to the cold suction tube 152.

Changing between cleaning the cold water tube 152 and cleaning the rest of the tubes is determined by the control unit 177. The control unit 177 is connected to the valves and the suction unit 140. The control unit 177 determines which of the valves are in closed state and which of the valves are in an open state. The control unit may determine the time allocated for cleaning the cold water unit 130 and the time required for cleaning the cold water tube 152.

In some exemplary cases, the cold suction tube 150 added to the water dispensing apparatus 105 is connected to the hot water unit 120, not to the cold water unit 130 as disclosed in the exemplary embodiment above. The cold suction tube 150 may be removable. In some cases, the water dispensing apparatus 105 may comprise connectors at both the hot water unit 120 and the cold water unit 130, for enabling connection of the suction tube as an add-on and not as an integral part of the water dispensing apparatus 105.

Figure 4:
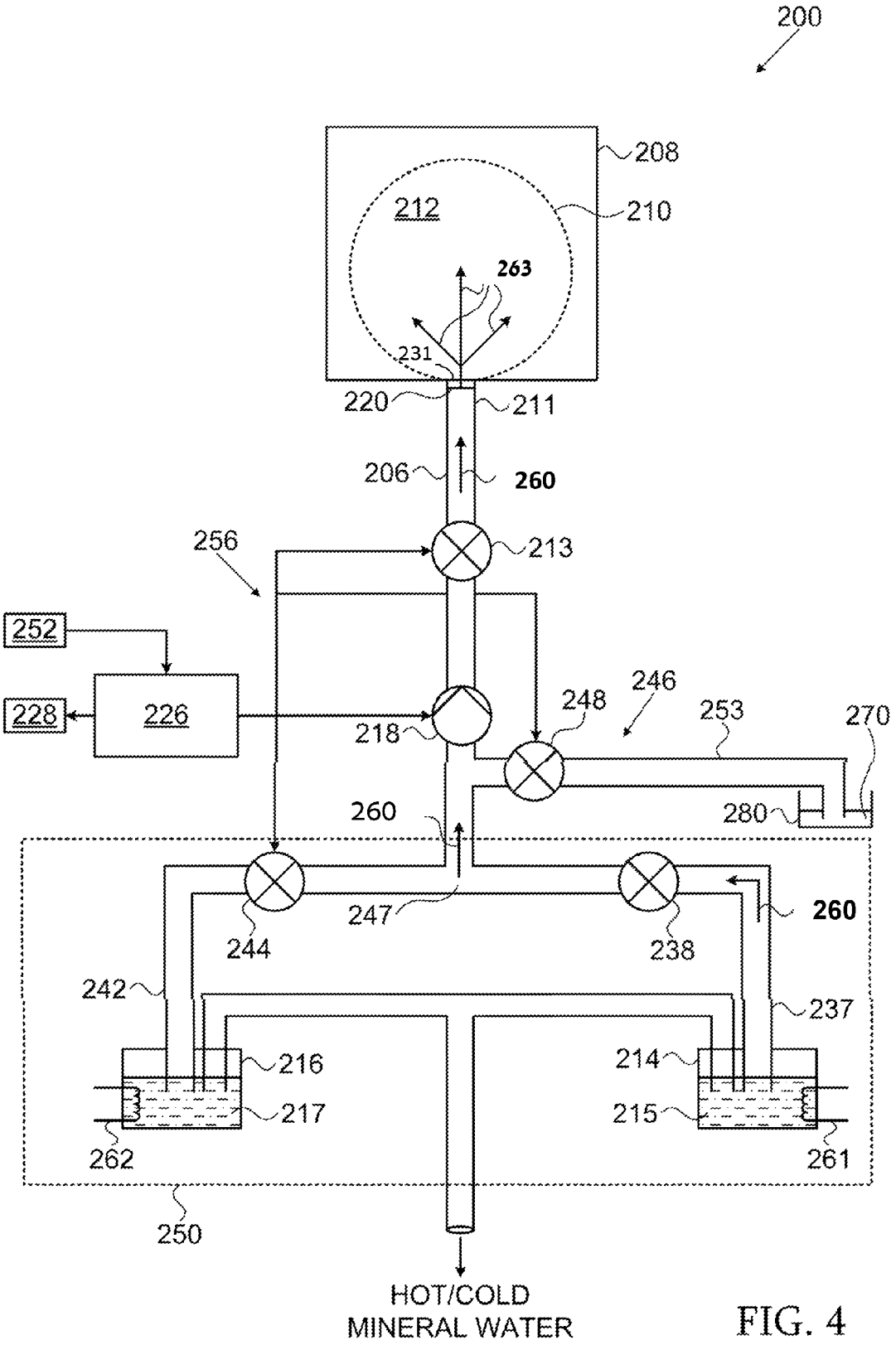
FIG. 4 schematically presents a hot/cold water dispenser in an arrangement for cleansing a mineral water container and an associated fluid flow system, in accordance with an embodiment of the present invention.

Reference is now made to FIG. 4, which schematically presents a hot/cold water dispenser 200 in an arrangement for cleansing a fluid flow system 206 and a fluid connector 220. The hot/cold water dispenser 200 provides hot and/or cold water to a user by means of the water dispensing system 250, shown schematically in FIGS. 4 and 5 and as is known in the art. The water dispensing system 250 includes, inter alia, a hot water reservoir 214 containing hot water 215 maintained at a temperature of above 90° C. by means of a water heater 261 and a cold water reservoir 216 containing cold water 217 maintained at a temperature of about 4-15° C. by means of a water cooler 262, as is known in the art. Selectively, mineral water 212, contained in the mineral water container 210, is supplied to the hot water reservoir 214 via a hot water valve 238 and a hot water conduit 237 and is supplied to the cold water reservoir 216 via a cold water valve 244 and a cold water conduit 242. The user operates the dispenser 200 by activating hot/cold water faucets (not shown), as is known in the art, thereby selectively obtaining hot water 215 and cold water 217 from the hot/cold water dispenser 200.

The hot/cold water dispenser 200 further includes, inter alia, a housing 208 enclosing the mineral water container 210, such as a Bag-in-a-Box storage (BIB) 210 containing the mineral water 212.

The fluid flow system 206 includes, inter alia, a fluid conduit 211 and a fluid connector 220. The fluid conduit 211 fluidly couples the fluid connector 220 to a sanitation valve 213. The BIB 210 is mechanically and fluidly coupled to the fluid connector 220 by the user of the water dispenser 200. Typically, the user manually couples an outlet of the BIB 210 to the fluid connector 220. The BIB 210 is in fluid communications with the fluid system 206 by means of the fluid connector 220.

A fluid pump 218, such as reversible fluid pump, is coupled between the fluid flow system 206 and the water supply system 250, as shown in FIG. 4. The fluid pump 218 is operationally configured to pump a fluid in a forward pumping direction and in a reverse pumping direction. In the forward pumping direction, the fluid pump 218 pumps water in the forward flow direction from the BIB 210 to the water supply system 250 via the fluid flow system 206. In the reverse pumping direction, the fluid pump 218 pumps water in the reverse flow direction from the water supply system 250 to the BIB 210 via the fluid flow system 206.

The fluid flow system 206 is fluidly coupled to the fluid pump 218 via the sanitation valve 213 and the fluid pump 218 is fluidly coupled to the water supply system 250 via a three-way fluid junction 247. The three-way fluid junction 247 fluidly couples the hot water reservoir 214 via the hot fluid conduit 237 and a hot flow valve 238 to the fluid pump 218. The three-way fluid junction 247 also fluidly couples the cold water reservoir 216 to the fluid pump 218 via the cold fluid conduit 242 and a cold flow valve 244.

A controller unit 226 controls the cleansing operation and is in communications with at least the fluid pump 218, the sanitation valve 213, the hot water valve 238 and the cold water valve 244, as shown in FIG. 4, via a communications bus 256. A display 228 is electrically coupled to the controller unit 226 and displays the operational status of the cleansing operation to a user and a control panel 252 is also electrically coupled to the controller unit 226 enabling the user to control the cleansing operation as well as supplying data and information to the controller unit 226, as described below.

In accordance with another embodiment of the present invention, the hot/cold water dispenser 200 includes a water drainage system 246 which is fluidly coupled to the junction 247, as shown in FIG. 4. The water drainage system 246 includes, inter alia, a drainage pump and/or drain valve 248, a drain fluid conduit 253 and a water drain 280. The fluid drainage system 246 provides a drainage system typically for draining residual water 270 (FIG. 5) remaining in the dispenser 200 following a cleansing operation. The opening and closing of the drainage pump and/or drain valve 248 is controlled by the controller unit 226 via the communications bus 256.

Following the emptying of the BIB 210, the user inserts a replacement BIB into the housing 208. The user inserts the replacement BIB in the housing 208 and couples the BIB 210 to the fluid connector 220, as described above. The replacement BIB is now in an operational status for resupplying the mineral water 212 to the water supply system 250.

In order to maintain the hot/cold water dispenser 200 in an hygienic status, the cleansing operation may be performed prior to replacing the empty BIB 210 with a replacement BIB unit. During the cleansing operation, hot water is pumped from the hot water reservoir 214 to the BIB 210 via the fluid flow system 206, spraying hot water into the BIB 210, as described below.

The controller unit 226 monitors and records the number of replacement BIB units inserted into the hot/cold water dispenser 200 and following the replacement of a predetermined number of BIB units, typically ten BIB units, the controller unit 226 initiates a cleansing operation of a current empty BIB unit 210 and the fluid conduit 211. It is appreciated that the user may alter the number of replacement BIB units by inputting the required information into the controller unit 226 by means of the control panel 252.

When the desired number of BIB units has been replaced, the controller unit 226 displays a notification, such as "INITIATE A CLEANSING OPERATION", on the display 228. Thus, the user is informed that the cleansing operation is being initiated. If the user does not wish to proceed with the cleansing operation, the user activates an appropriate control on the control panel 252 of the controller unit 226 and the cleansing operation terminates. A notification, such as "CLEANSING OPERATION USER TERMINATED", appears on the display 228.

If the user wishes to proceed with the cleansing operation, the user activates the appropriate activation control on the control panel 252 and the cleansing operation proceeds. The controller unit 226 checks the temperature of the hot water 215 contained in the hot water reservoir 214. If the hot water 215 is at a required temperature for the cleansing operation, typically at approximately 90° C., a notification, such as "CLEANSING OPERATION INITIATED", appears on the display 228.

If the hot water temperature is less than the required temperature, the controller unit 226 forwards a heat-water instruction to the water heater 261 to commence a heating operation to heat the water in the hot water reservoir 214 to the required temperature. A notification, such as "WATER HEATING OPERATION IN PROGRESS", appears on the display 228. On reaching the required hot water temperature, a notification, such as "WATER HEATED TO REQUIRED TEMPERATURE", appears on the display 228.

Upon completion of heating of the water in the hot water reservoir 214, alternatively, if the hot water in the hot water reservoir 214 is at the required temperature, the cleansing operation commences and a notification, such as "CLEANSING OPERATION COMMENCING", appears on the display 228. The controller unit 226 instructs the fluid pump 218 to reverse the pumping direction of the pump 218 to the reverse pumping direction.

Concomitantly with instructing the fluid pump 218 to reverse the pumping direction, the controller unit 226 instructs the cold water valve 244 to close and the hot water valve 238 and the sanitation valve 213 to open. On receiving confirmation that the cold water valve 244 has closed and the hot water valve 238 and the sanitation valve 213 have opened, the controller unit 226 instructs the fluid pump 218 to commence pumping a quantity of hot water from the hot water reservoir 214 to the fluid flow system 206 and the BIB 210. The quantity of hot water pumped from the hot water tank when cleaning the fluid flow system 206 may be in a range of 5-50 ml. A notification, such as "CLEANSING OPERATION IN PROGRESS", appears on the display 228.

The fluid pump 218 commences pumping the quantity of hot water from the hot water reservoir 214 to the BIB 210 via the fluid flow system 206, as indicated by a flow arrow 260. The quantity of hot water 231 reaches the fluid connector 220 and is sprayed into the BIB 210 as indicated by spray arrows 263. Thus, the flow conduit 211 is cleansed with hot water. The pumping operation continues for a first predetermined time period, typically for a period of three seconds.

At the termination of the first predetermined time period, the controller unit 226 instructs the fluid pump 218 to cease pumping. The quantity of hot water is retained in the fluid conduit 211, the fluid connector 220 and the BIB 210 for a predetermined cleansing time period, typically for a time period of three minutes, typically at a temperature of approximately 90° C. In alternative embodiments, prior to the user replacing the BIB 210, the residual hot water 270 is drained from the dispenser 200, as described below.

At the termination of the cleansing time period, a notification, such as "CLEANSING OPERATION COMPLETED", appears on the display 228.

Figure 5:
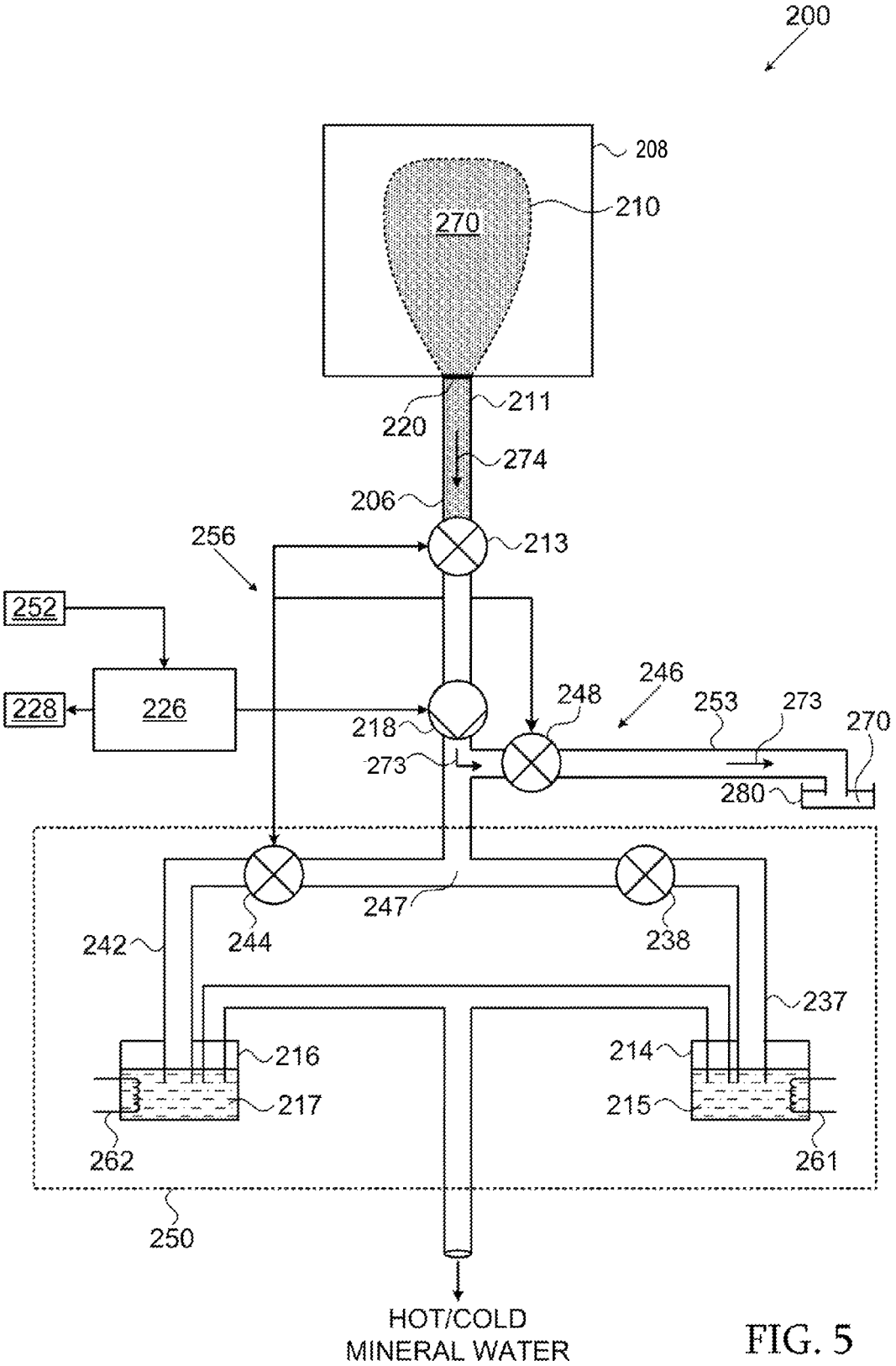
FIG. 5 schematically presents the hot/cold dispenser in an arrangement for draining the residual hot water from the hot/cold water dispenser, in accordance with an embodiment of the present invention.

Reference is now made to FIG. 5, which schematically presents the hot/cold dispenser 200 in an arrangement for draining the residual hot water 270 from the hot/cold water dispenser 200, in accordance with an embodiment of the present invention. Subsequent to completion of the cleansing operation of the BIB unit 210 and the flow fluid system 206, the controller unit 226 forwards an instruction to the pump 218 to change the pumping direction from the reverse direction to the forward direction.

In accordance with another embodiment of the present invention, concomitantly with forwarding the change pump-direction instruction, the controller unit 226 instructs the hot water valve 238 to close and instructs the drainage pump and/or drain valve 248 to open. The cold water valve 244 remains closed and the sanitation valve 213 remains open. Thus, a fluid flow pathway is established from the BIB 210 to the water drainage system 246 via the fluid conduit 211 and the fluid connector 220, as indicated by the flow arrows 273, 274.

On receiving confirmation that the hot water valve 238 is closed and that the drainage pump and/or drain valve 248 is opened, the controller unit 226 instructs the fluid pump 218 to commence pumping for a predetermined period of 1-10 seconds and the residual water 270 is pumped from the BIB 210, the fluid connector 220 and the fluid conduit 211 to the water drainage system 246 as indicated by a fluid flow arrows 273, 274.

Thus, the residual hot water 270 is drained from the BIB 210 and the fluid flow system 206 to a water drain 280 via the drainage flow system 246, or back to the hot water reservoir 214.

Subsequent to draining the residual hot water 270 from the dispenser 200, the user is able to replace the empty BIB unit with a replacement full BIB 210 and reuse the hot/cold water dispenser 200 following the cleansing operation.

It is appreciated that the user has an option to operate the hot/cold water dispenser 200 in an energy-saving mode. In the energy-saving mode, the temperature of the hot water 215 is typically maintained at a temperature of approximately 60° C. Alternatively, the user may not wish to heat the water in the hot water reservoir 214 and the water therein is typically at room temperature.

Additionally or alternatively, as described above, the user has an option not perform the cleansing operation.

However, in order to maintain the hygiene of the dispenser 200, subsequent to the replacement of typically 10 BIB units, the controller unit 226 checks the temperature of the hot water 215 each time the user replaces a BIB unit. If a cleansing operation is not initiated after the replacement of, typically, 10 BIB units, the controller unit 226 continues to check the temperature of the hot water 215 each time a BIB unit is replaced. When the user selects to operate the dispenser 200 on an energy saving mode or to disable the heating unit, the controller unit 226 provides the user with a message recommending performing the sanitation process disclosed above. The controller unit 226 may sample the temperature of the hot water tank every predefined number of BIB units, to suggest the user to perform the sanitation process in case the temperature of the hot water tank is back to normal, for example above 85 degrees.

While the disclosure has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this invention, but only by the claims that follow.

The invention claimed is:

1. A water dispenser comprising:

a water container;

a water supply system configured to supply water in a forward direction from the water container to a hot water reservoir via a hot water conduit and to a cold water reservoir via a cold water conduit, and in a reverse direction from the hot water reservoir to the water container via the hot water conduit, and from the cold water reservoir to the water container via cold water conduit, and further configured to provide hot water from said hot water reservoir and cold water from said cold water reservoir to a user of said water dispenser;

a fluid flow system, supplies water in the forward direction from the water container to the water supply system via a fluid conduit, and in the reverse direction from the water supply system to the water container via the fluid conduit;

a reversible fluid pump fluidly coupling said fluid flow system and said water supply system, said pump configured to pump in the forward direction, and for a cleansing operation to pump in the reverse direction a quantity of hot water from said hot water reservoir through an open hot water valve on the hot water conduit, and into the water container via the fluid flow conduit of said fluid flow system, for cleansing at least said fluid flow system and the water container; and a control unit in communication with the fluid pump for controlling the pumping direction and the cleansing operation, wherein said control unit instructs a cold water valve on the cold water conduit to close prior to the cleansing operation.

2. The water dispenser according to claim 1, wherein said fluid flow system comprises a fluid connector for fluidly coupling said fluid flow conduit and said water container.

3. The water dispenser according to claim 1, wherein said control unit is operable to reconfigure said fluid pump to pump in the forward direction.

4. The water dispenser according to claim 1, wherein said water container comprises a bag-in-box container.

5. The water dispenser according to claim 1, wherein said pump is configured to pump the quantity of hot water from said hot water reservoir to the water container during at least first time period when the water container is empty.

6. The water dispenser according to claim 5, wherein said first time period is in a range of 1 second to 15 seconds.

7. The water dispenser according to claim 5, wherein said quantity of hot water cleanses said fluid flow system during a second time period.

8. The water dispenser according to claim 7, wherein said second time period is in a range of 1 minute to 7 minutes.

9. The water dispenser according to claim 1, further comprising a display electrically coupled to said control unit and being operable to display a status of the cleansing operation.

10. The water dispenser according to claim 1, wherein said quantity of hot water is in the range of 5-50 ml.

11. The water dispenser according to claim 1, further comprising a drain valve, wherein said drain valve is configured to an open state while draining residual water remaining in the water dispenser following said cleansing operation.

12. The water dispenser according to claim 5, wherein said drain valve is configured to a closed state during at least the first time period.

13. A method for performing a cleansing operation on a water dispenser, the method comprising:

providing a water dispenser, the water dispenser comprising a water container, a water supply system configured to supply water in a forward direction from the water container to a hot water reservoir via a hot water conduit and to a cold water reservoir via a cold water conduit, and in a reverse direction from the hot water reservoir to the water container via the hot water conduit, and from the cold water reservoir to the water container via the cold water conduit, and further configured to provide hot water from said hot water reservoir and cold water from said cold water reservoir to a user of said water dispenser, and a fluid flow system, supplies water in the forward direction from the water container to the water supply system via a fluid conduit, and in the reverse direction from the water supply system to the water container via the fluid conduit;

commencing the cleansing operation by closing a cold water valve on the cold water conduit;

configuring a reversible fluid pump of the water dispenser configured to pump fluid in the forward direction, and via a control unit during the cleansing operation to pump in the reverse direction a quantity of hot water from said hot water reservoir through an open hot water valve on the hot water conduit into the water container via the fluid conduit of said fluid flow system; and cleansing said water container using said fluid flow system with said quantity of hot water.

14. The method for cleansing a water dispenser according to claim 13, comprising pumping the quantity of hot water from said hot water reservoir to the water container for at least a first time period, said pumping performed when the water container is empty.

15. The method for cleansing a water dispenser according to claim 14, comprising cleaning said water container and said fluid flow system during a second time period.

16. The method according to claim 14, wherein said first time period is in a range of 1 second to 15 seconds.

17. The method according to claim 14, comprising drain valve to a closed state during at least the first time period.

18. The water dispenser according to claim 2, wherein the control unit instructs the fluid pump to cease pumping, and further wherein said quantity of hot water is retained in the fluid conduit, a fluid connector and the water container for a third predetermined cleansing time period.

19. The water dispenser according to claim 1, wherein the control unit further instructs the hot water valve and a sanitation valve to open prior to the cleansing operation.

20. The water dispenser according to claim 1, wherein the temperature required for the cleansing operation is approximately 90° C.

* * * * *